United States Patent [19]

Saito

[11] 4,168,141

[45] Sep. 18, 1979

[54] SAFETY IGNITION MEANS FOR BURNER INSTALLATIONS

[75] Inventor: Yoshimasa Saito, Kawasaka, Japan

[73] Assignee: Robertshaw Controls Company, Richmond, Va.

[21] Appl. No.: 822,914

[22] Filed: Aug. 8, 1977

[30] Foreign Application Priority Data

Aug. 11, 1976 [JP] Japan ..... 51/95674

[51] Int. Cl.[2] ..... F23Q 9/08

[52] U.S. Cl. ..... 431/43; 431/51; 431/73; 431/69

[58] Field of Search ..... 431/43, 45, 46, 47, 431/69, 73

[56] References Cited

U.S. PATENT DOCUMENTS

| | | | |
|---|---|---|---|
| 2,102,091 | 12/1937 | Persons | 431/69 |
| 3,644,074 | 2/1972 | Cade | 431/46 |
| 3,713,766 | 1/1973 | Donnelly et al. | 431/69 |
| 3,902,839 | 9/1975 | Matthews | 431/46 |
| 4,025,283 | 5/1977 | Ray | 431/45 |

*Primary Examiner*—Carroll B. Dority, Jr.

*Attorney, Agent, or Firm*—Fulwider, Patton, Rieber, Lee & Utecht

[57] ABSTRACT

Safety ignition means for burner installations having a solenoid of a solenoid operated valve connected to a power source through a normally opened relay switch. The relay switch has a hold coil connected to the power source and a make coil connected to the power source through a flame switch which operates, when the flame switch is heated by the flame of the pilot burner, to energize a solenoid of a solenoid operated valve for main burner and de-energize the make coil. A normally closed bimetal switch is connected between a power supply and the safety ignition means and has a heat source connected in series with the make coil. If the pilot burner is not ignited for a predetermined period of time, the heat source heats the bimetal switch so that the bimetal switch is opened to separate the ignition means from the power supply.

6 Claims, 6 Drawing Figures

SAFETY IGNITION MEANS FOR BURNER INSTALLATIONS

This invention relates to safety ignition means for a burner.

Various safety ignition means for burners have hitherto been known. However, they have been provided with neither safety measure for coping with variations in voltage supplied to the burner safety ignition means nor sufficient counter-measures to cope with ignition failure in a pilot burner or main burner.

It is therefore an object of this invention to provide new and improved safety ignition means for burner devices in which the above mentioned defects are eliminated.

Another object of this invention is to provide safety ignition means for burner installations, which acts to hold solenoid operated valve means for a main burner in a closed condition when a pilot burner is not ignited because of insufficient increase in ignition coil temperature caused due to variations in a voltage applied to the ignition coil and other causes.

A further object of the invention is to provide safety means for burner installations, which is adapted to be separated from a power source to close solenoid operated valve means for burner means when the burner means is not ignited even after lapse of a predetermined period of time from initiation of the burner ignition means.

According to this invention, there is provided safety ignition means for burner installations, which comprises power line means adapted to be connected to a power source; a normally closed delay operating switch located between said power source and said power line means and having a timer means; burner igniting heat source connected to said power line means; a relay switch having a make coil and a hold coil; the hold coil being connected to said power source line; a solenoid of a solenoid operated valve for burner means connected through said relay switch to said power line means; said timer means of said delay operating switch and said make coil of said relay switch being connected to said power line means through a flame switch, said flame switch being operative in response to the burner flame to disconnect said timer means and said make coil from said power line means. When no burner flame is established for a predetermined period of time, said delay operating switch is opened by said timer means to separate the ignition means from the power source. In a preferred embodiment of this invention, the delay operating switch is a bimetal switch and the timer means is a heat source for heating the bimetal switch.

The above and other objects and effects of this invention will become apparent from the following description of preferred embodiments of this invention with reference to the accompanying drawings, in which.

Figure 1:
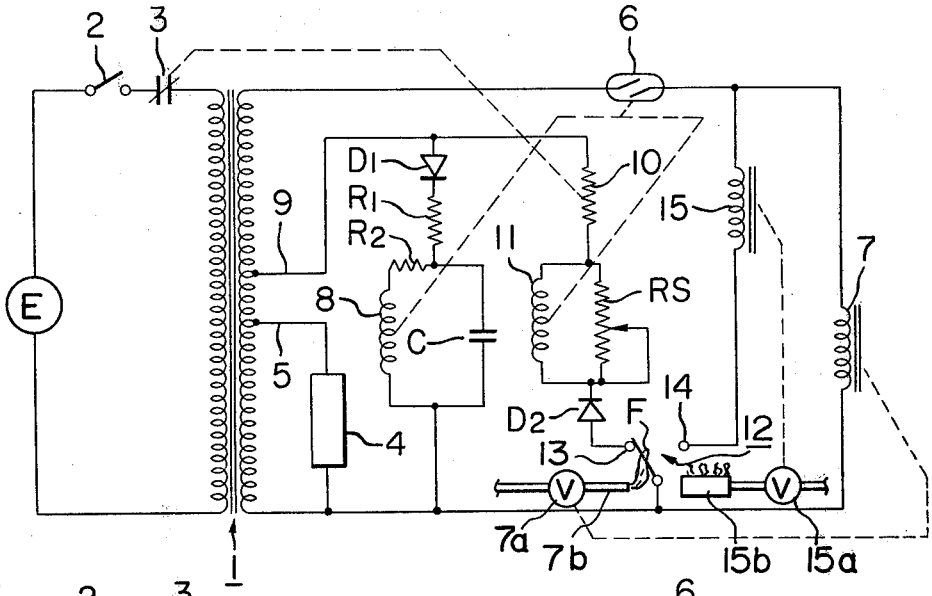
FIG. 1 is an electric circuit diagram showing an embodiment of the burner safety ignition means according to this invention.
Figure 2:
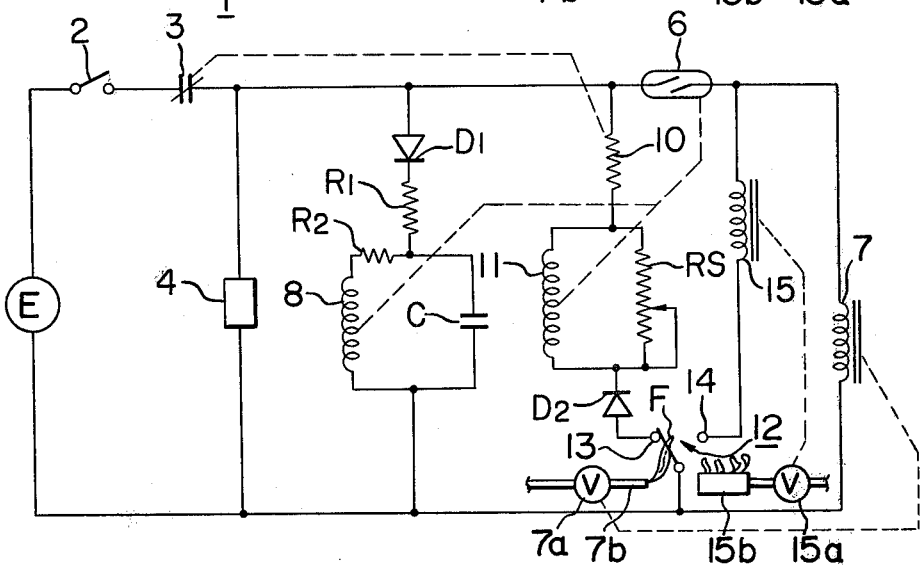
FIG. 2 is a view similar to FIG. 1, but showing a modification of the embodiment of FIG. 1.
Figure 3:
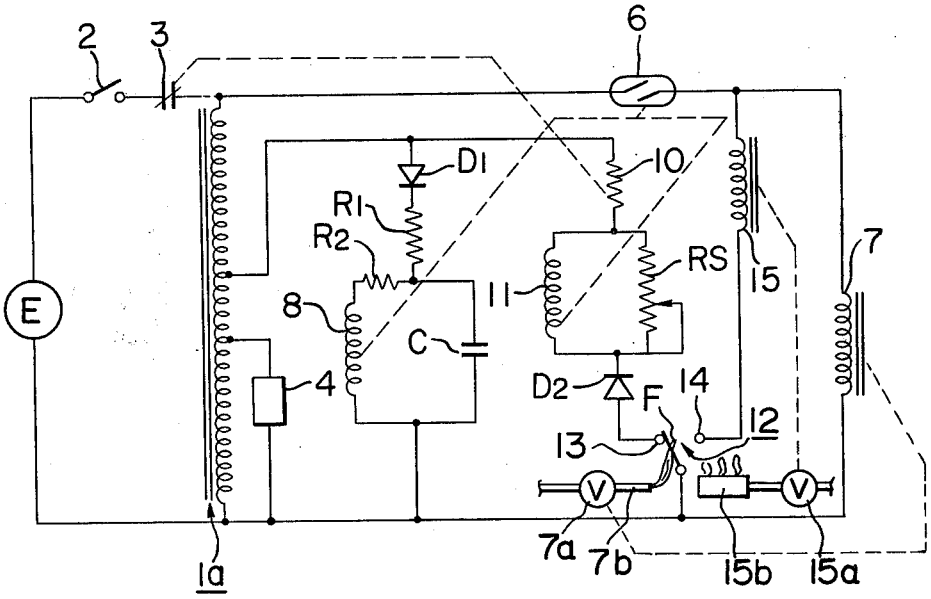
FIG. 3 is a view similar to FIG. 1, but showing another modification of the embodiment of FIG. 1.

Referring to FIGS. 1, 2 and 3, burner safety ignition means according to this invention are shown in the form of a circuit diagram. These safety ignition means have entirely the same construction and operate in the same way except that the means shown in FIG. 1 uses a transformer 1 having a secondary winding, the means of FIG. 2 uses no transformer and the means of FIG. 3 uses an auto-transformer 1*a*.

In FIG. 1, the primary winding of the transformer 1 is connected across a power source E through a thermostat 2 and a delay operating switch such as a normally closed bimetal switch 3. The thermostat 2 is, for instance, assembled in a temperature controller for a boiler or the like and is adapted to be opened and closed for temperature control.

The secondary winding of the transformer 1 has a first tap 5 connected to a heat source 4 such as an ignition coil for igniting a pilot burner 7*b*. A relay switch such as a normally opened reed switch 6 and a solenoid 7 of a solenoid operated valve 7*a* for pilot burner 7*b* are connected in series across the secondary winding of the transformer. The reed switch 6 has a hold coil 8 connected in series with a diode D1 and resistors R1 and R2 to a second tap 9 of the secondary winding. A capacitor C is connected in parallel with the series connection consisting of the hold coil 8 and the resistor R2. The second tap 9 is also connected through a series connection consisting of a timer for the delay operating switch such as a heat source 10 for heating the bimetal switch 3, a make coil 11 for the reed switch 6 and a diode D2 to one stationary contact 13 of a flame switch 12. A solenoid 15 of a solenoid operated valve 15*a* for main burner 15*b* is connected to the secondary winding through the other stationary contact 14 of the flame switch 12. The make coil 11 for the reed switch 6 is connected in parallel with a variable resistor RS for adjustment.

The flame switch 12 has a heat-sensitive section disposed in the vicinity of the pilot burner 7*b* and is adapted to move its movable contact from the one contact 13 to the other contact 14 when the heat-sensitive section is heated by the flame F of the pilot burner 7*b*. The flame switch is well-known to a person skilled in the art, and therefore, detailed description will be omitted here. FIG. 1 shows the state in which the flame switch has not yet sufficiently heated by the flame of the pilot burner. The flame switch is switched to the contact 14 when sufficiently heated.

THe hold coil 8 and the make coil 11 for the reed switch 6 are designed such that they produce sufficient magnetic flux to close the reed switch 6 when both of them are simultaneously energized and that the reed switch 6 is held in the closed condition, so long as the hold coil is energized. But, the reed switch is never brought into the closed condition by energizing only either of the hold coil 8 and the make coil 11, and the energization of only the make coil does not maintain the reed switch 6 in the closed condition.

The bimetal switch 3 is adapted such that when the period of energization of the heat source 10 for the bimetal switch exceeds a predetermined period, the bimetal heat-deforms to open the switch.

The burner safety ignition means described above operates in the following way. When the thermostat 2 is closed, the primary winding of the transformer 1 is energized through the bimetal switch 3, whereby all the circuit elements excluding the solenoid 15 of the solenoid operated valve 15*a* for the main burner 15*b* are energized. As is apparent from FIG. 1, the heat source for igniting the pilot burner is heated while the transformer 1 is energized. When the reed switch 6 is closed due to energization of the hold coil 8 and the make coil 11, the solenoid 7 is energized to open the solenoid operated valve *7a* for the pilot burner *7b*, whereby the pilot burner *7b* is ignited by the pilot burner igniting heat source 4. When the heat-sensitive section of the flame switch 12 is heated by the flame of the pilot burner the flame switch is switched from the contact 13 to the contact 14. As a result, the make coil 11 for the reed switch 6 and the heat source 10 for the bimetal switch 3 are de-energized, but the reed switch 6 is held in the closed condition by the hold coil 8. At the same time, the solenoid 15 is energized to open the solenoid operated valve 15*a* for the main burner 15*b*, whereby the main burner 15*b* is ignited by the pilot burner *7b*. The above is the normal ignition operation.

In the above operation, in a case where the pilot burner fails to ignite, for example, due to the fact that a decrease in the supplied voltage does not permit the pilot burner igniting heat source 4 to reach the ignition temperature, the flame switch 12 is not heated, and consequentially is not switched to the contact 14, whereby the solenoid 15 of the solenoid operated valve 15*a* for the main burner 15*b* is never energized. Thus, the solenoid operated valve 15*c* for the main burner 15*b* does not open. When the pilot burner *7b* is still not ignited by the continuously energized heat source 4, the heat source 10 for the bimetal switch is heated during this period of time. Then, after the lapse of a predetermined period of time, the bimetal switch 3 is opened to separate the entire circuit of the ignition means from the power source, thereby de-energizing the solenoid of the solenoid operated valve *7a* for the pilot burner *7b* so as to allow the solenoid operated valve *7a* to be returned to the closed condition. Thus, there is no possibility of a considerable amount of non-combusted gas being discharged as it is at the time of burner ignition failure.

Even though the pilot burner is extinguished by some cause during the burning operation of the burner, re-ignition is made since the heat source 4 for igniting the pilot burner remains energized. However, if re-ignition is not obtained in a short time so that the heat-sensitive section of the flame switch 12 is cooled down, the flame switch 12 is returned from the contact 14 to the contact 13, whereby the solenoid 15 is de-energized to allow the solenoid operated valve 15*a* for the main burner 15*b* to be returned to the closed condition. Thereafter, if the pilot burner is re-ignited, the flame switch is switched again to the contact 14, so that the main burner is re-ignited. On the other hand, if re-ignition is not obtained, the bimetal switch 3 is opened as in the previous case, thereby separating the ignition means from the power source and rendering all of the solenoid operated valves closed.

Further, since the solenoid of the solenoid operated valve for the main burner is adapted to be energized only after the ignition of the pilot burner and since the reed switch for energizing the solenoid of the solenoid operated valve for the pilot burner is adapted to be energized when both of the make coil and the hold coil is energized, safety of opening and closing the solenoid operated valves for the main burner and pilot burner is further enhanced.

In the safety ignition circuit shown in FIGS. 2 and 3, the same elements as those shown in FIG. 1 are given the same reference numerals as those given in FIG. 1. The safety ignition circuit shown in FIG. 2 has the same construction as that shown in FIG. 1, except that the transformer 1 is omitted and that the heat source 4, the diode D1, the heat source 10 and the reed switch 6 are directly connected to the power line. The circuit of FIG. 2 operates in the same manner as that of the circuit of FIG. 1. Furthermore, the safety ignition circuit shown in FIG. 3 has entirely the same construction and operation as those of the circuit of FIG. 1 except that an auto-transformer 1*a* is used in place of the transformer 1.

Figure 4:
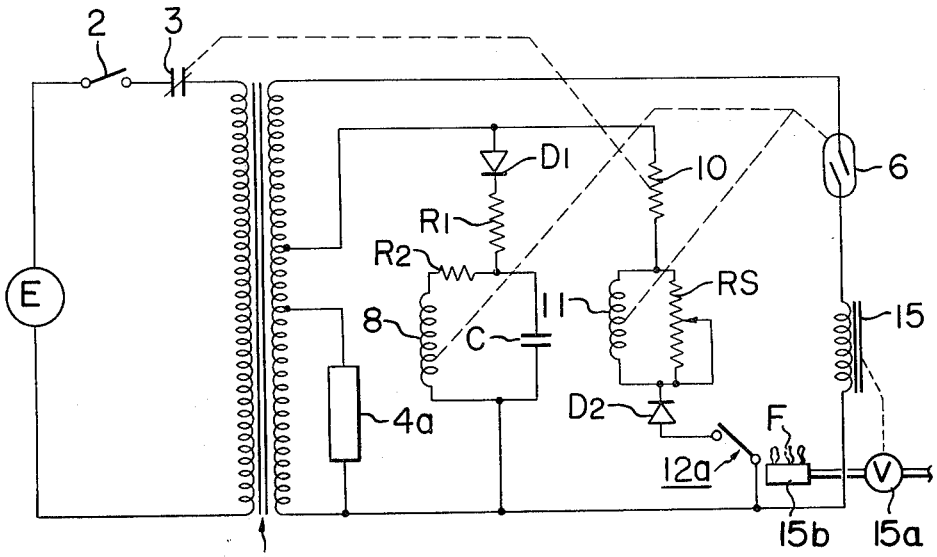
FIGS. 4, 5 and 6 are a circuit diagram showing modifications of the embodiments of FIGS. 1, 2 and 3 modified for application to the main burner direct ignition type.
Figure 5:
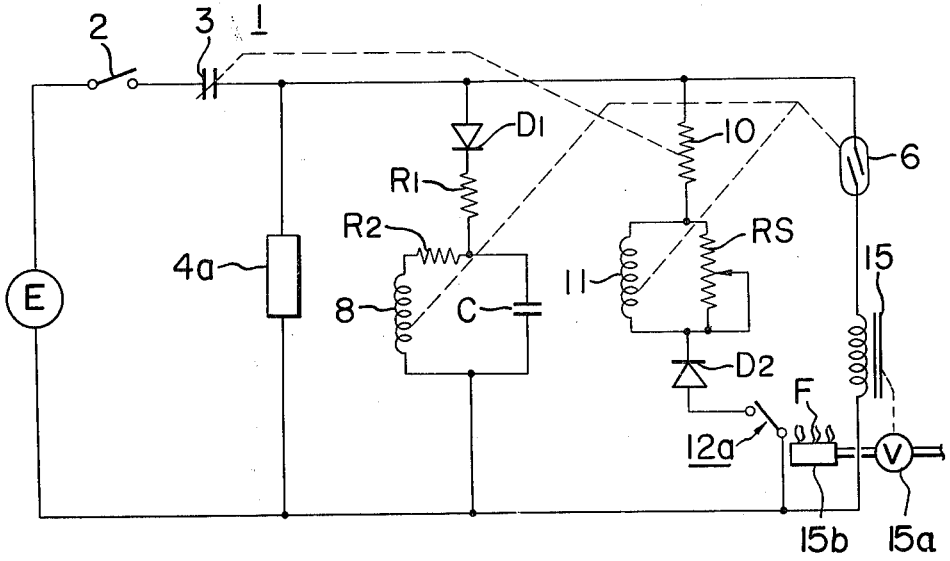
Figure 6:
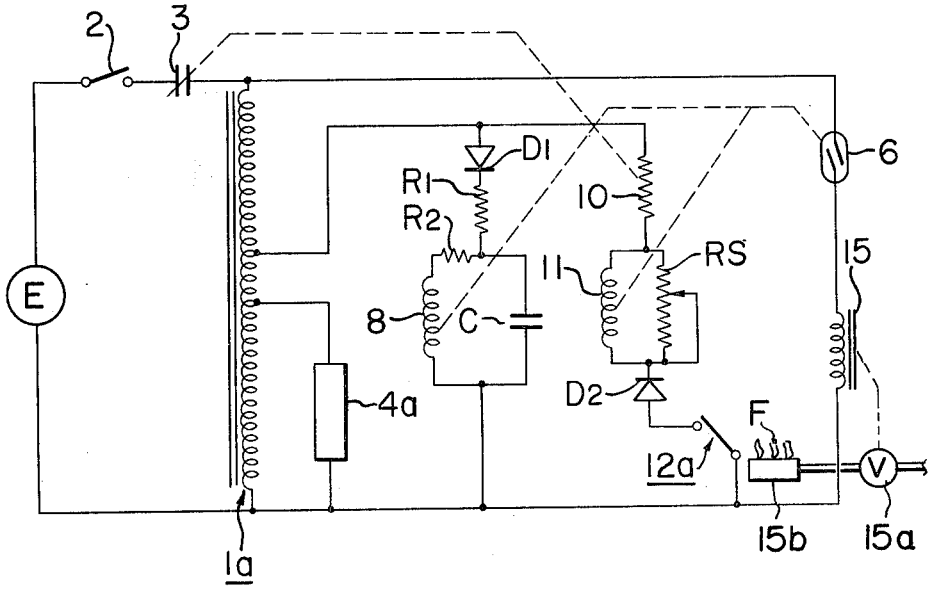

FIGS. 4, 5 and 6 respectively show modifications of the safety ignition means respectively shown in FIGS. 1, 2 and 3. In these Figures, circuit elements identical to those in FIGS. 1, 2 and 3 are designated by the same reference numerals. These modifications are applied to burner systems of the type in which a main burner is directly ignited without using a pilot burner. In these embodiments, the solenoid 15 of the solenoid operated valve 15*a* for the main burner 15*b* is connected in series with the reed switch 6, and the solenoid 7 of the solenoid operated valve *7a* for the pilot burner *7b* in FIGS. 1, 2 and 3 is omitted. A flame switch 12*a* which has no contact corresponding to the contact 14 is used. The flame switch 12*a* is disposed in the vicinity of the main burner 15*b* and is adapted to be opened when a heat-sensitive section thereof is heated by the flame of the main burner. A heat source 4*a* for igniting the main burner is disposed in the vicinity of the main burner.

These modified embodiments operate as follows. When the thermostat 2 is closed, the heat source 4*a* for ignition of the main burner is energized and the hold coil 8 and the make coil 11 for the reed switch 6 are also energized to close the reed switch 6, whereby energizing the solenoid 15 of the solenoid operated valve 15*a* for the main burner 15*b*. As a result, the solenoid operated valve for main burner is opened to cause the main burner to be ignited by the main burner igniting heat source 4*a*. With the ignition of the main burner, the heat-sensitive section of the flame switch is heated to open the flame switch 12*a*. If the main burner is not ignited or is extinguished during operation of the burner, the igniting operation is continuously made by the main burner igniting heat source 4*a*. However, if ignition is not obtained by this operation, the flame switch 12*a* is kept in or returned back to the closed condition and consequentially the bimetal switch 3 is opened by heating of the associated heat source 10, thereby separating the ignition means from the power source and closing the solenoid operated valve for main burner. In this way, the emission of non-combusted gas during ignition failure or extinguishment of the main burner is prevented.

It should be understood that various changes and modifications may be made without departing from the scope and spirit of this invention.

I claim:

1. Safety ignition means for burner installations comprising power line means adapted to be connected to a power source; a normally closed delay operating switch located between said power source and said power line means and having a timer means; burner igniting heat source connected to said power line means; a relay switch having a make coil and a hold coil, means connecting the hold coil to said power source line at all times when said operating switch is closed; a solenoid of a solenoid operated valve for burner means connected through said relay switch to said power line means; said timer means of said delay operating switch and said make coil of said relay switch being connected to said power line means through a flame switch, and said flame switch being operative in response to the burner flame to disconnect said timer means and said make coil from said power line means, whereby, when no burner flame is established above a predetermined period of time, said delay operating switch is opened by said timer means so as to separate the ignition means from the power source.

2. Safety ignition means according to claim 1 in which said delay operating switch is a bimetal switch and said timer means is a heat source for heating said bimetal switch.

3. Safety ignition means according to claim 2 in which said solenoid is a solenoid of a solenoid operated valve for said burner means.

4. A safety ignition means according to claim 3, in which said burner igniting heat source, said solenoid of the solenoid operated valve for the said burner means, said hold coil for the relay switch, and said flame switch, said make coil for said relay switch and said heat source for said bimetal switch, which are connected in series, are connected to said power line means through a transformer.

5. Safety ignition means according to claim 2 wherein said burner means comprises a pilot burner and a main burner and means according to claim 2 in which said solenoid is a solenoid of a solenoid operated valve for said pilot burner and further including a solenoid of a solenoid operated valve for said main burner connected through said flame switch to said power line means, said flame switch being operative to normally connect said make coil of said relay switch and said heat source for said bimetal switch to said power source and, in response to the burner flame, to de-energize said make coil and said heat source for said bimetal switch and to energize said solenoid of the solenoid operated valve for main burner.

6. A safety ignition means according to claim 5, in which said burner igniting heat source, said solenoid of the solenoid operated valve for said pilot burner, said hold coil and said make coil for the relay switch and said solenoid for the solenoid operated valve for main burner are connected to said power line means through a transformer.

* * * * *